US011939031B2

(12) United States Patent
Cohen

(10) Patent No.: US 11,939,031 B2
(45) Date of Patent: Mar. 26, 2024

(54) PADDLEBOARD PROPULSION SYSTEM AND METHOD

(71) Applicant: IMPOSSIBLE R&D, INC., Palm Bay, FL (US)

(72) Inventor: Howard Cohen, Indialantic, FL (US)

( * ) Notice: Subject to any disclaimer, the term of this patent is extended or adjusted under 35 U.S.C. 154(b) by 280 days.

(21) Appl. No.: 17/382,309

(22) Filed: Jul. 21, 2021

(65) Prior Publication Data

US 2022/0024548 A1 Jan. 27, 2022

Related U.S. Application Data

(60) Provisional application No. 63/054,457, filed on Jul. 21, 2020.

(51) Int. Cl.

| | |
|---|---|
| ***B63B 32/10*** | (2020.01) |
| ***B63B 32/40*** | (2020.01) |
| ***B63B 32/66*** | (2020.01) |
| ***B63B 32/77*** | (2020.01) |
| ***B63H 1/14*** | (2006.01) |
| ***B63H 21/17*** | (2006.01) |

(52) U.S. Cl.

CPC ..... *B63B 32/10* (2020.02); *B63B 32/40* (2020.02); *B63B 32/66* (2020.02); *B63B 32/77* (2020.02); *B63H 1/14* (2013.01); *B63H 21/17* (2013.01)

(58) Field of Classification Search

CPC ..... B63B 32/10; B63B 32/40; B63B 32/66; B63B 32/77; B63H 1/14; B63H 21/17

See application file for complete search history.

(56) References Cited

U.S. PATENT DOCUMENTS

| | | | | |
|---|---|---|---|---|
| 9,975,616 | B2 * | 5/2018 | Radenbaugh | B63B 34/10 |
| 2012/0196494 | A1 * | 8/2012 | Preston | B63B 32/10 440/66 |
| 2018/0346078 | A1 * | 12/2018 | Fry | B63B 32/10 |
| 2020/0148312 | A1 * | 5/2020 | Duff | B63B 7/085 |
| 2020/0317304 | A1 * | 10/2020 | Bell | F21S 4/28 |

* cited by examiner

*Primary Examiner* — Andrew Polay

(74) *Attorney, Agent, or Firm* — Lowndes; Stephen C. Thomas

(57) ABSTRACT

A system for propelling a paddleboard or surfboard along the surface of a body of water, comprising a controller motor coupled to a propeller, a rechargeable battery, a controller which may be wearable on the wrist of a user, and a housing structure that is adapted to be attached to the fin box of a paddleboard without the need to remove the fin. The apparatus presents a low-drag profile, has a long battery life for extended range, and is able to be controlled so that user may operate the paddleboard at any desired speed, and in a forward or rearward direction, or in a controllable direction of thrust. The housing structure is adaptable to various fin box T-bolt separation distances.

19 Claims, 6 Drawing Sheets

PADDLEBOARD PROPULSION SYSTEM AND METHOD

CROSS REFERENCE TO RELATED APPLICATIONS AND INCORPORATION BY REFERENCE

This non-provisional patent application is a non-provisional of, and claims benefit of priority to, U.S. provisional patent application Ser. No. 63/054,457, entitled PADDLEBOARD PROPULSION SYSTEM AND METHOD, filed in the United States Patent and Trademark Office on Jul. 21, 2020, the disclosure of which is incorporated herein by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to systems and methods for motivating a paddleboard, surfboard or other device for carrying a person across the surface of a body of water. More particularly, the field of the invention relates generally to systems and methods for providing an apparatus that is easily attachable to a paddleboard, surfboard or other device for carrying a person across the surface of a body of water, is self-powered, and is controllable with respect to the amount of thrust applied to the paddleboard, surfboard or other device for carrying a person across the surface of a body of water. An apparatus of the invention may be adapted so as to be easily attached to a paddleboard, surfboard or other device for propelling the paddleboard, surfboard or other water vehicle across the surface of a body of water, for example as an aftermarket device. The field of the invention also relates to the field of self-powered paddleboards, surfboards or other devices for carrying a person across the surface of a body of water.

2. Background Art

There exist in the art structures that are adapted to be motivated along the surface of a body of water such as, for example and not by way of limitation, paddle boards and surfboards. It is often the case that such structures are adapted, or intended, to be motivated across the surface of a body of water by a form of paddling. Such paddling may be accomplished by lying on the structure and using a person's hands to paddle the structure in a forward direction or a rearward direction; by sitting on one's knees and paddling in a forward or rearward direction; or by standing on the structure and using a paddle dip into the water, stroking through the water such that the structure is propelled along the surface of the water. Such paddling can be awkward and physically challenging. For example, a person may not be of sufficient strength, or have sufficient endurance, to paddle in such a manner as to achieve a desired velocity or traverse a desired distance along the surface of a body of water. Furthermore, the act of paddling itself may cause imbalance due to the lever arm created by the distance from the center of effort of the paddle traversing through the water propelling the paddleboard forward or rearward, and the center of resistance of the paddleboard itself. Furthermore, as the distance between the center of effort of the paddle and the fulcrum point of the persons arm increases, the effort required to cause the paddle to traverse the water increases. Still further, in the case in which a person is using a single paddle to propel the paddleboard, the center of effort of the paddle is offset from the center of resistance of the paddleboard longitudinal axis, causing the paddleboard to tend to turn in the water when paddled. This may require frequent changes of hand of the paddle such that the paddleboard is first paddled on one side, and then paddled on the other side in order to correct the direction of travel of the paddleboard as it is being tattled. This change of hand of the paddle coupled with the offset of the center of effort in the center of resistance of the paddleboard not only leads to increased fatigue but represents an opportunity for the user of the paddleboard to lose their balance and, in some cases fall off the paddleboard. Even further, there are many instances in which those who have physical disabilities for other challenges desire to use a paddleboard to traverse the surface of a body of water, but are unable to do so because they may be effectively prevented from paddling due to their physical challenges. Thus, there are many physical factors operating to create fatigue that, in many cases, do not allow a user to achieve a desired velocity along the surface of the water, or do not allow a person to traverse a desired distance along the surface of the water.

Certain systems and methods have been proposed for providing motivating power to a paddleboard. These systems typically include modification to the paddleboard structure, or a specialized paddleboard structure that is adapted to receive a motivating apparatus at the time of manufacture. These systems are expensive and are economically out of the reach of most persons who view paddle boarding as a hobby.

What is needed in the art, therefore, is an apparatus and/or method adapted to be installed on a paddleboard on an aftermarket basis, i.e., as a retrofit apparatus, in such a manner that does not require modification of the existing paddleboard structure, and is manufacturable at a cost that places it within the economic reach of those who view paddle boarding as a hobby.

BRIEF SUMMARY OF THE INVENTION

The present invention comprises an apparatus and method that have one or more of the following features and/or steps, which alone or in any combination may comprise patentable subject matter.

It is an object of the invention to provide controllable propulsion to a padddleboard.

It is an object of the invention that a user may control the propulsion of a paddleboard from a standing, kneeling, or sitting position while the user is disposed on an upward facing surface of the paddleboard.

It is an object of the invention that the paddleboard propulsion system is able to be assembled onto a paddleboard without the need to remove or replace the paddleboard fin, and without the need for a plurality of tools.

It is an object of the invention to present a small surface area cross section to the flow of water when the paddleboard is moving in a forward direction in order to minimize drag on the invention as it moves through the water, thus increasing the maximum forward speed of the paddleboard and extending battery life and range.

The present invention overcomes the shortcomings of the prior art in that it is adapted to be installed on a paddleboard after the time of manufacture, that is, on an aftermarket or retrofit basis. The present invention does not require modification of a standard paddleboard structure, which is to say the present invention is adapted to be attached to a paddleboard without requiring modification of the paddleboard structure as it was produced by the original equipment manufacturer (OEM). Furthermore, an additional advantage of the paddleboard propulsion system of the invention is that it may be installed on a paddleboard without requiring removal of the paddleboard fin.

In accordance with one embodiment of the present invention, the invention comprises a structure adapted to be attached to a paddleboard, the structure adapted to be retained by attachment to the paddleboard fin box using one or more T-headed bolts; a housing structure having an upper surface and a lower surface; an electric motor operable to rotate the shaft, thereby spinning a propeller attached to the shaft such that thrust is developed, the thrust characterized as having a direction; and a battery in communication with the motor; wherein the battery is enclosed within said housing, and wherein the electric motor is attached to the housing such that the direction of thrust is parallel to a desired direction of travel of the its handled board along the surface of a body of water caused by the operation of the electric motor. In embodiments, the thrust direction is directed along a longitudinal axis of the paddleboard.

In embodiments, the paddleboard propulsion system may further comprise an opening in the housing structure to allow a fin 103 attached to the paddleboard fin box 104 to extend through the housing 108 and protrude into the water, such that removal of the fin is not required to attach the paddleboard propulsion system to the paddleboard.

The paddleboard propulsion system may further comprise an optional strap 101 that extends around the paddleboard and passes through the housing structure 108, so as to retain the paddleboard propulsion system 200 to a water-facing surface of the paddleboard.

The motor may be in electrical communication with a controller and the controller may comprise control circuitry for controlling the angular velocity of the rotation of the motor shaft. The electrical communication may be accomplished by electrically conductive wiring or by wireless signals, such as RF signals.

In embodiments, the electrical communication may be accomplished wirelessly.

In embodiments, the controller may be wearable on the wrist of a user.

In embodiments, the controller may be a mobile device such as a smart phone, wearable device, or tablet.

In embodiments the invention comprises a controllable apparatus and system for propelling a paddleboard along the surface of a body of water, comprising: a structure adapted to be attached to a water-facing surface of a paddleboard, the structure having an opening therethrough allowing a fin mounted in a fin box of the paddleboard to protrude through the structure; a controllable electric motor attached to the structure, the controllable electric motor having a shaft with a propeller attached thereto, the controllable electric motor operable to rotate the propeller such that thrust is developed when the paddleboard is floating on a body of water, the thrust tending to motivate said paddleboard in a direction of travel along the surface of the body of water; a controller in communication with the controllable electric motor, the controller having a user interface for receiving input commands from a user for controlling the motor shaft rotation speed; and a battery in electrical communication with said motor for providing electric power to the motor; wherein the amount of thrust produced when the propeller is rotated is controllable by a user inputting commands for controlling the motor shaft rotation speed into the controller user interface; and wherein the structure is adapted to be attached to a water-facing surface of the paddleboard without requiring said fin to be removed.

In embodiments the direction of rotation of said motor shaft is controllable by a user inputting commands into the controller user interface such that the direction of thrust generated by the propeller is reversible upon command by a user.

In embodiments, the invention further comprises a strap passing through the structure and extending around the paddleboard so as to retain the housing to a water-facing surface of the paddleboard.

In embodiments, the structure may be attached to said water-facing surface of the paddleboard by one or more T-bolts, wherein said one or more T-bolt heads are captured in a receiving grooves in said fin box.

In embodiments, the battery may be contained within a housing forming a portion of the structure.

In embodiments, the controller may be a handheld controller, in wired or wireless electrical communication with said controllable electric motor.

In embodiments, the controller may be wearable on the wrist of a user, and the controller may be in wired or wireless electrical communication with the controllable electric motor.

In embodiments the invention may comprise a processor in communication with the electric motor, and the controller may be defined as a mobile device in wireless communication with the processor, wherein commands input into the controller by a user through a controller user interface are communicated by the controller to the processor, and wherein the processor communicates the commands to the electric motor such that the electric motor is responsive to user commands for controlling the electric motor shaft rotation speed.

In embodiments the invention may comprise one or more controllable light sources disposed in the housing, the lights being disposed so as to illuminate the water underneath the apparatus and paddleboard. In embodiments, each of the one or more light sources may be controllable as to intensity, and wherein the one or more light sources may be in communication with the controller, and the controller may be adapted to receive commands input into said controller's input interface for controlling the intensity of the one or more light sources.

In embodiments the invention may comprise a controllable servo motor or rotary actuator interposed between the controllable electric motor and the housing, such that the direction of thrust of the controllable electric motor is able to be controllably rotated in a plane that is parallel to a plane formed by surface of the body of water, and wherein the controllable servo motor or rotary actuator may be in communication with the controller such that the user is able to control the direction of the angle of thrust produced by the propeller by inputting commands into the user interface of the controller.

In embodiments objects of the invention include: 1) a user who is disposed on an upper surface of the paddleboard is able to control the speed of the paddleboard by entering commands into a controller; 2) a user who is disposed on an upper surface of the paddleboard is able to control the direction of thrust applied to the paddleboard, either forward or reverse direction, by entering commands into a controller; and 3) the apparatus of the invention is able to be quickly and removably attached to a water-facing surface of the paddleboard without the need to remove the paddleboard fin.

In the various embodiments of the invention, any or all of the described features, functions or steps of the invention may be present, in any combination. In other words, the drawings provide one exemplary embodiment of the invention, and not all of the described features, functions or steps are required to be present in all embodiments.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

In the figures, like callouts refer to like elements.

DETAILED DESCRIPTION OF THE INVENTION

Figure 1:
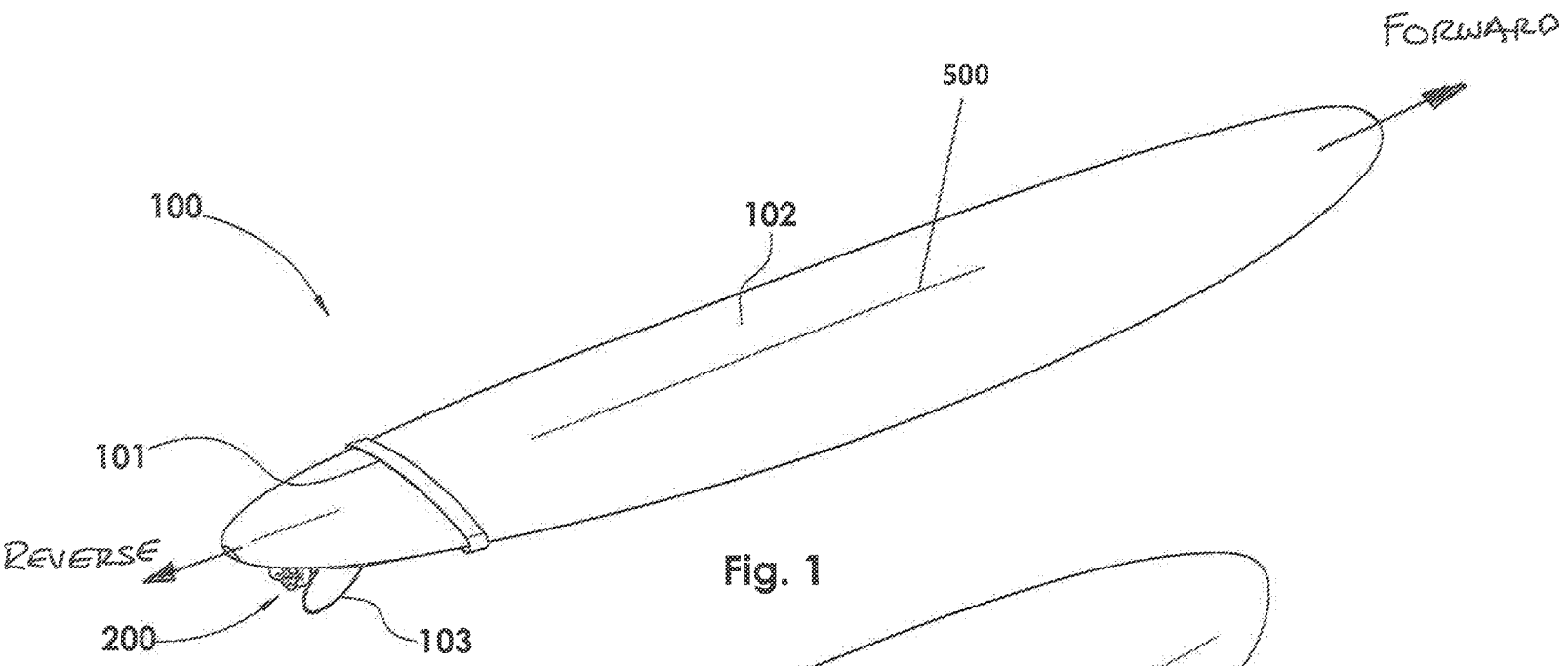
FIG. 1 depicts a perspective top view of a paddleboard having an embodiment of the invention removably attached thereto, showing the apparatus of the invention attached to a water facing surface of a paddleboard as it would be attached in normal operation.

The following documentation provides a detailed description of the invention.

As used herein, "paddleboard" includes within its meaning any structure that is adapted to be motivated along the surface of a body of water, and to accommodate a person so that the person may be disposed on the upward facing surface of the paddleboard while the paddleboard is being motivated along the surface of the body of water. Thus, "paddleboard" includes within its meaning standup paddleboards (SUPs), surfboards, and all other structures that are adapted to be motivated along the surface of a body of water such as, for example, kayaks and canoes. Such structures may comprise any type of material suitable for constructing a structure that is adapted to be motivated along the surface of a body of water such as for example fiberglass, roto-molded plastic, molded plastic, soft closed cell foam, drop-stitched materials, and other structural composite materials such as carbon fiber, wood, and any other material, in any combination. Also included within the definition of "paddleboard" are structures that include materials that in and of themselves may be of a higher density than that of water, that when used in combination with less dense materials including gasses such as air, result in a structure that has a density less than the density of water such that the structure is adapted to float on the surface of a body of water. Such structures may include, for example and not by way of limitation, hollow sections, or may include open sections that allow the structure to carry a mass, while still floating on the body of water by displacing an appropriate amount of water to account for the mass of the structure plus its load. Thus, included within the definition of "paddleboard" are structures such as a common boat structure.

As used herein, "fin box" includes within its meaning an elongated rectangular structure having an opening for receiving a fin. The fin box may be fixedly attached, or removably attached, to an underneath, i.e., water-facing, surface of the paddleboard. The elongated rectangular structure may be aligned along a lengthwise centerline, or longitudinal axis, of the paddleboard. The fin box may be attached to the paddleboard such that a fin inserted into and retained by the fin box provides directional control of the paddleboard in a direction aligned with a desired direction of travel of the paddleboard along the surface of a body of water; such desired direction is typically, but is not always, aligned with a centerline or longitudinal axis of the paddleboard. The fin box may be attached to and retained within a cavity disposed in an underneath, or water-facing, surface of the paddleboard; in other words, the surface of the paddleboard that is in contact with the surface of the water when the paddleboard is placed onto the surface of a body of water in normal operation in which a person may be disposed on an upward facing surface of the paddleboard. The fin box may be attached to the paddleboard by any means known in the art, such as, for example and not by way of limitation, chemical bonding such as using adhesives and two-part epoxies.

As used herein, the "water facing" surface of paddleboard is the surface of the paddleboard that, in normal use while paddling with a person disposed on an upward facing surface of the paddleboard, rests in the water in a substantially horizontal orientation, with the fin mounted in the fin box extending down into the water. I.e. the water facing surface of the paddleboard is the underneath surface, when the paddleboard is resting on the surface of a body of water and is oriented for normal use, with the fin extending down into the water.

As used herein, the "upward facing" surface of a paddleboard is the surface of the paddleboard upon which a person would be disposed while using the paddleboard in normal operation, i.e., while the water facing surface of paddleboard is disposed in the water in a substantially horizontal orientation, with the fin extending down into the water.

As used herein, "mobile device" includes within its meaning any electronic device that is usable in a handheld or wearable fashion by a user, typically having a processor in communication with a computer readable memory that has stored upon it non-transitory computer readable and executable instruction this is in communication with the processor; a user data output interface such as a visual display or speaker, or both, that is in communication with the processor; and a device for receiving user input such, for example, a soft keyboard, a touchscreen display, a mouse or external keyboard or microphone that is in communication with the processor. The mobile device processor may be in communication with a processor 1000 of the invention, which may be housed in the housing structure 108, or directly with the motor of the propulsion assembly, either wirelessly through, for example, radio frequency (RF) signals, or via electrical wiring, so that a user of the paddleboard is able to input commands into the mobile device that are then communicated to processor 1000 such that the user is able to control the motor as to speed of rotation, including stopping the motor completely, and to commend any other functions and features of the invention as described herein. Non-limiting examples of a mobile device are smart phones, smart watches, and electronic tablets. The computer readable memory may comprise non-transitory computer readable and executable instructions for carrying out the steps and functions of receiving input from a user, providing output to a user.

Referring now to FIG. 1, a perspective top view of an embodiment of a paddleboard 102 having an embodiment of the invention 200 attached to the water facing side of the paddleboard, is depicted. The invention 200 and the paddleboard 102 may form a system for motivating a person 100 along the surface of a body of water. In this view, optional strap 101 wraps around the paddleboard and passes through the paddleboard housing structure 108 (not shown in FIG. 1, but depicted in FIGS. 3-5), and may be used, in embodiments, to help secure the invention to the water facing side of the paddleboard 102. Strap 101 is optional. Fin 103 can be seen protruding from the water facing side of the paddleboard. The paddleboard may have a longitudinal axis 500 that runs lengthwise of paddleboard 102 along a centerline of paddleboard 102, along which the paddleboard tends to be motivated by paddling or by embodiments of the invention, as directed by fin 103.

Still referring to FIG. 1, the forward and reverse directions of propulsion are indicated.

Figure 2:
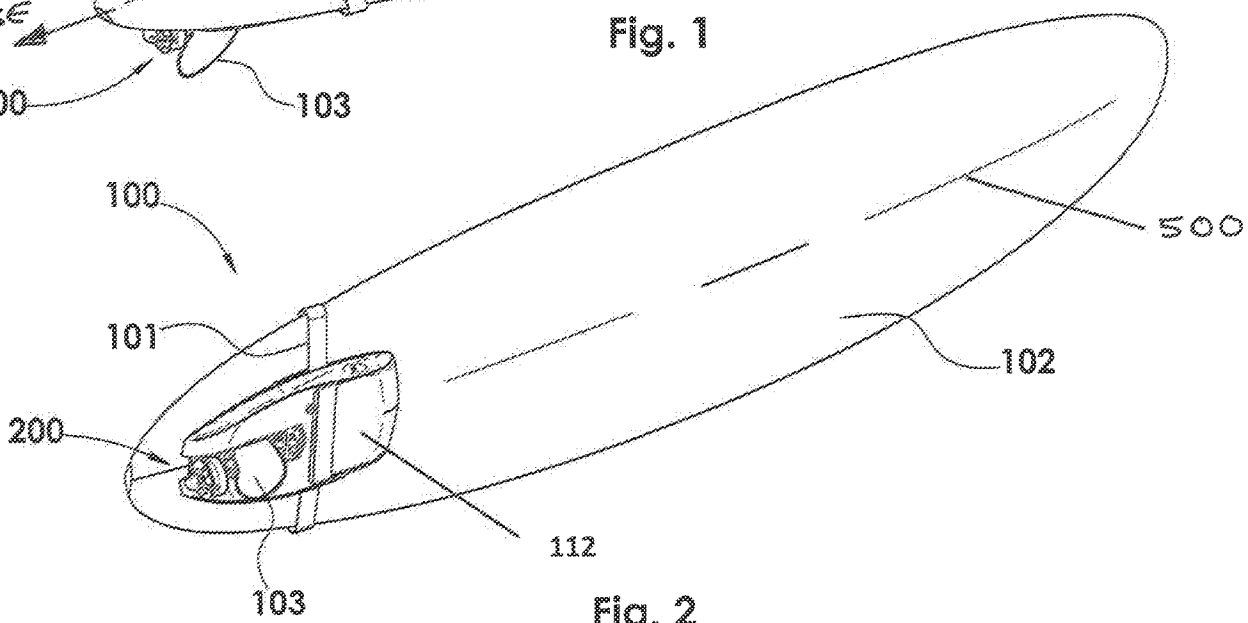
FIG. 2 depicts a perspective bottom view of a paddleboard having an embodiment of the invention removably attached thereto, showing the apparatus of the invention attached to a water facing surface of a paddleboard as it would be attached in normal operation.

Referring now to FIG. 2, a perspective bottom view of a paddleboard 102 having an embodiment of the invention 200 attached thereto, on the water facing side of the paddleboard, is depicted. In this view, optional strap 101 wraps around the paddleboard and passes through the paddleboard housing structure 108, and may be used, in embodiments, to help retain the paddleboard propulsion device 200 to the water facing side of the paddleboard. Strap 101 is optional. Fin 103 can be seen protruding from the water facing side of the paddleboard. The paddleboard may have a longitudinal axis 500, along which the paddleboard 102 tends to be motivated by paddling or by the thrust provided by embodiments of the invention. Removable cover 112 is shown for reference.

Figure 3:
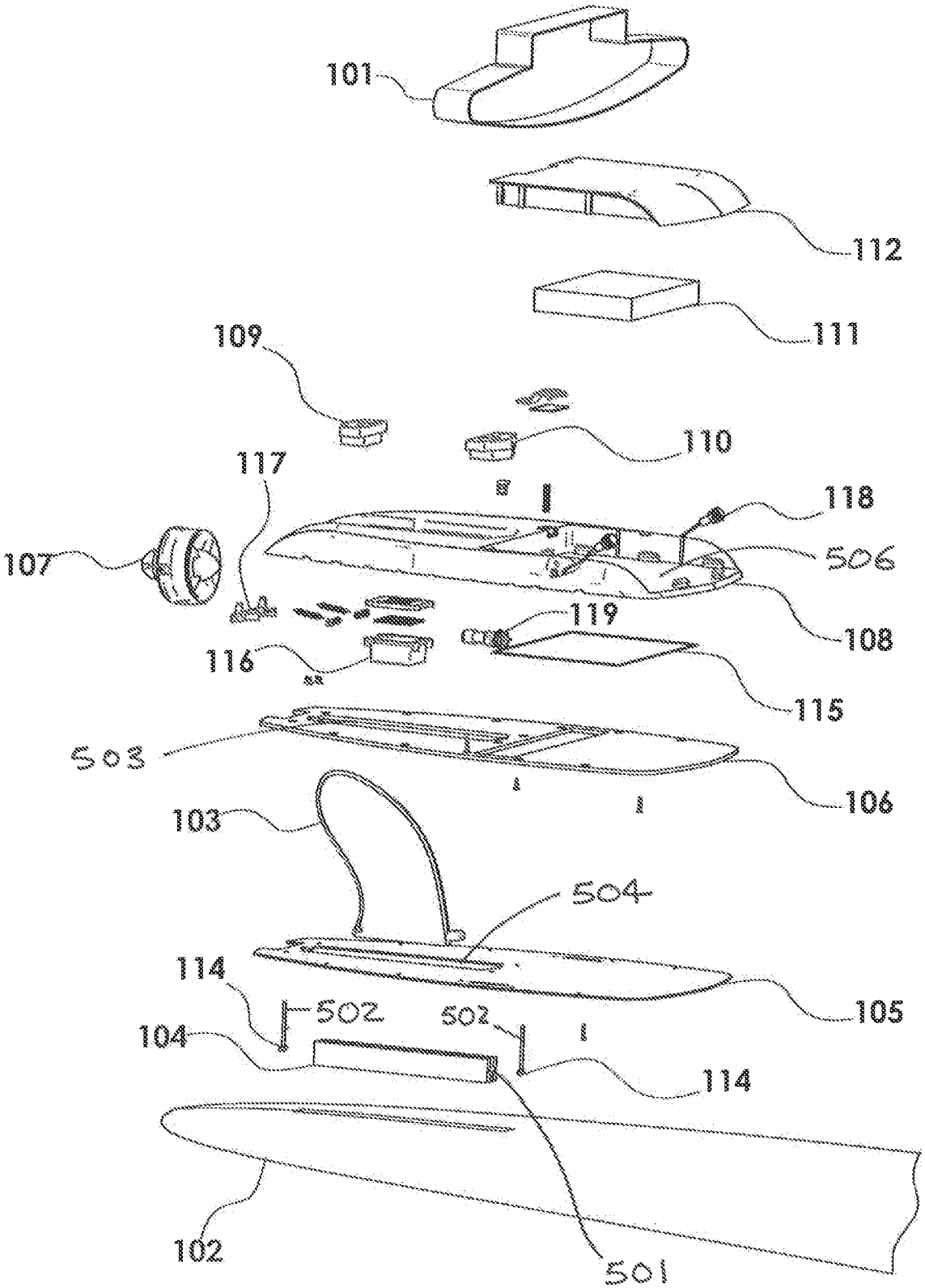
FIG. 3 depicts an exploded view of an embodiment of the invention as well as an exploded view of an exemplary embodiment of a paddleboard, fin and fin box.

Referring now to FIG. 3, an exploded view of an embodiment of the paddleboard propulsion system 200 of the invention is depicted. Fin box 104 is shown in exploded fashion from paddleboard 102, however it is to be understood that fin box 104 is an integral part of paddleboard 102 and is received by and retained in an opening, or recess, 500 in paddleboard 102 and is a part of paddleboard 102. Thus, fin box 104, while it may be supplied in some instances with paddleboard propulsion system 200, is typically an integral part of a paddleboard 102 to which the paddleboard propulsion system 200 is attached. Paddleboard T-bolts 114 have elongate T-bolt heads that are able to slide lengthwise along receiving grooves 501 that are formed lengthwise in fin box 104. Paddleboard T-bolt heads 114 are retained in receiving grooves 501 in fin box 104 by operation of the elongate head of paddleboard T-bolts 114 being received by the lengthwise grooves 501 in fin box 104. Paddleboard T-bolts 114 may have a threaded male portion 502 extending outward from the water facing surface of paddleboard 102, and they are of sufficient length to extend through propulsion system plate 105 to be received by mating female threaded fasteners that are captured in paddleboard bolt retaining brackets 109 and 110. Thus, when paddleboard T-bolts 114 are tightened in their threaded engagement in in paddleboard bolt retaining brackets 109 and 110, the paddleboard propulsion system 200 is retained and pulled against paddleboard 102 water-facing surface. Paddleboard bolt retaining brackets 109 and 110 are able to slide lengthwise in housing structure 108 along a track that is parallel to the longitudinal axis 500 of paddleboard 102 such that they may be positioned to receive paddleboard T-bolts 114 at various distances between paddleboard T-bolts 114 so as to accommodate different lengths of fin boxes as well as accommodate fins 103 of various dimensions. The paddleboard propulsion system of the invention 200 is retained onto the water facing surface of paddleboard 102 by operation of paddleboard T-bolts 114 having elongate heads that retained in the lengthwise slots, or grooves, 501 of fin box 104, extending through paddleboard mounting plate 105, plate 106, through housing 108 and into a threaded engagement in receiving female threaded fastener structures that may be retained in paddleboard bolt retaining brackets 109 and 110, or may form part of nuts that are tightened down against a surface of retaining brackets 109 and 110. Optional strap 101 may further be used to retain the paddleboard propulsion system of the invention 200 onto the water facing surface of paddleboard 102 by extending around paddleboard 102 and having a portion thereof molded to fit the exterior dimensions and shape of paddleboard housing structure 108, or, alternatively, may pass through paddleboard housing structure 108, such that, when optional strap 101 is in place it snugly holds the paddleboard propulsion system 200 onto the water facing surface of paddleboard 102. Strap 101 is an optional feature and may not be present in all embodiments of the invention. Strap 101 may have an adjustable length that is adjustable so as to be tightened to snugly hold the paddleboard propulsion system 200 onto the water facing surface of paddleboard 102 by any means known in the art, such as, for example, cam-action tighteners. Alternatively, optional strap 101 may comprise an elastic material that is stretchable to allow propulsion system 200 to be assembled onto the water facing surface of paddleboard 102 as shown, and then, when released, optional strap 101 may, by its elastic nature, attempt to return to its un-stretched state, snugly holding paddleboard propulsion system 200 onto the water facing surface of paddleboard 102 by elastic forces.

Figure 5:
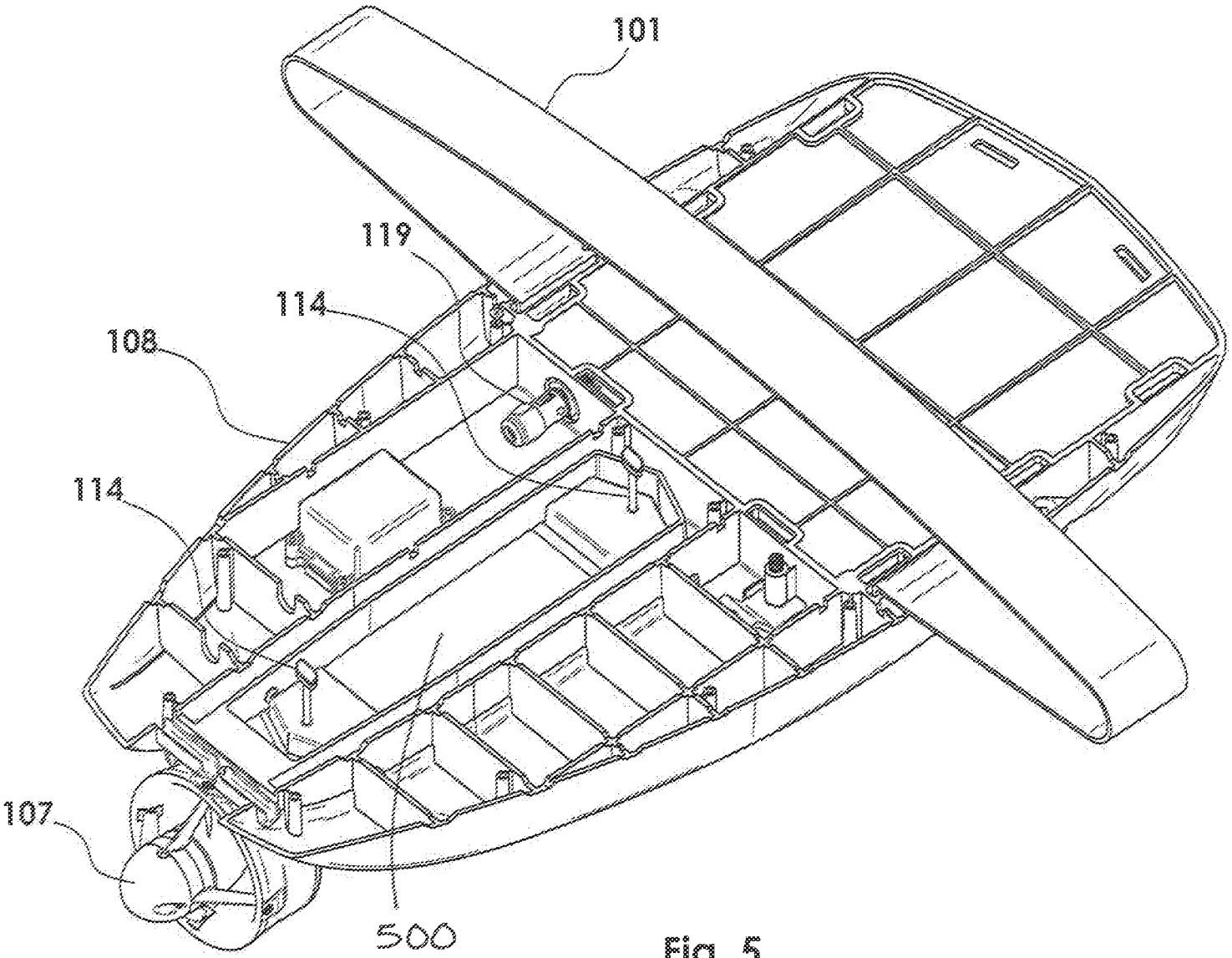
FIG. 5 depicts a perspective view of an embodiment of the invention from above the invention. In this view the top plate is not depicted so that the structure of the housing is more clearly viewable.

Still referring to FIG. 3, propulsion system plate 105, plate 106, and housing structure 108 may comprise openings 504, 503, and 500 (opening 500 is not shown in FIG. 3 but is shown in FIG. 5), respectively, through which fin 103 is able to protrude, such that fin 103 may be mounted into fin box 104 with fin 103 extending away from the water facing side of paddleboard 102, through opening 504 in propulsion system plate 105, through opening 503 in plate 106, and through opening 500 in paddleboard housing structure 108, such that fin 103 extends into the water underneath paddleboard 102 to provide directional control of the paddleboard, as the fin would normally do when the paddleboard 102 is used without propulsion system 200 installed. Thus, in this manner, paddleboard propulsion system 200 may be installed onto a paddleboard 102 without requiring fin 103 to be removed from the paddleboard. This allows for easy installation and removal of propulsion system 200 as desired by a user.

Still referring to FIG. 3, battery or electronics, or both, 111 may be disposed in a cavity 506 formed in housing structure 108 which is enclosed by cover 112. In embodiments, cover 112 may be a watertight cover, but in alternate embodiments it is not necessary that cover 112 be a watertight cover. In embodiments, the cavity 506 may be made watertight by operation of watertight cover 112 and gasket 115, which may be an O-ring gasket that may seal the interface between housing structure 108 and plate 106. Battery or electronics, or both 111 may be electrically connected to additional batteries or electronics, or both 116, which may in turn be electrically connected to controllable electric motor/propeller 107. Controllable electric motor/propeller 107 may comprise a controllable electric motor attached, the controllable motor having a rotable shaft with a propeller attached thereto. The electrical connections of the invention may be accomplished by electrically conductive wiring and electrical connectors such as connector 119. The non-power connections of the invention, may, in embodiments, be wireless connection such as, but not necessarily radio frequency (RF) connections. Electrical connectors 118 may be watertight connectors and may be used to electrically connect propulsion system 200 to the electrical cable of a controller held, for example, by a user standing, sitting or kneeling on the upper surface of paddleboard 102 such that a user may control the speed of the paddleboard.

Still referring to FIG. 3, cover 112 may be removeably attached to paddleboard housing structure 108.

Figure 4:
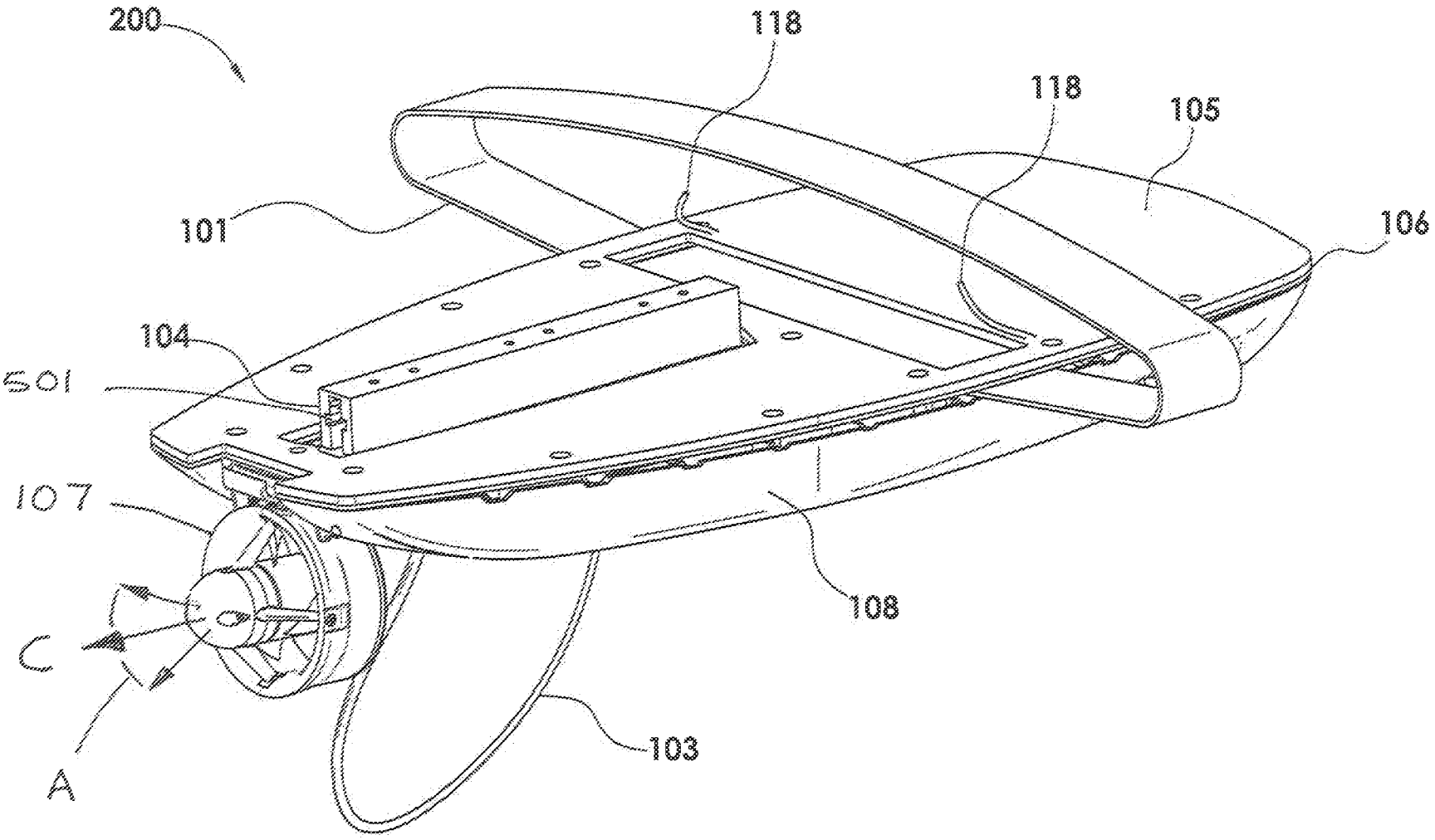
FIG. 4 depicts a perspective view of an embodiment of the invention, assembled, from slightly above the invention. In this view, a paddleboard is not depicted, but a paddleboard fin and fin box are shown for reference.

Referring now to FIG. 4, in embodiments, controllable electric motor/propeller 107 may be attached to housing structure 108 in an attachment that may be a controllable rotating attachment comprising an optional controllable servo motor or angular actuator 1008 allowing for the adjustment of the angle of the direction of thrust vector C produced by controllable electric motor/propeller 107 in a plane that is parallel to a plane formed by the surface of a body of water upon which the paddleboard 102 is disposed. The adjustment of thrust vector C may sweep a range of angles as depicted by arc A. Generally, thrust vector C produced by the rotating propeller of controllable electric motor/propeller 107 is directed in a rearward direction, propelling paddleboard 102 in a forward direction. However, in the embodiment that comprise a controllable rotating attachment between controllable electric motor/propeller 107 and housing structure 108, a user may adjust the direction of the thrust vector C over a range of angles A, allowing the user to apply thrust having a component transverse to paddleboard longitudinal axis 500. This may be useful for controlling the paddleboard in a turn, or offsetting currents in the body of water. Thus, controllable electric motor/propeller 107 may be attached to paddleboard housing structure 108 in a controllable, rotating attachment that allows a user to control the angle of the thrust vector relative to the paddleboard longitudinal axis 500.

Referring now to FIGS. 4 and 5, perspective views of an embodiment of a paddleboard propulsion system 200 is depicted standalone, in other words, not assembled onto a paddleboard 102. In FIG. 4, fin 103 and fin box 104 is depicted for reference in order to show its relationship to propulsion system plate 105. However, it is to be understood that normally fin box 104 forms an integral part of paddleboard 102. Optional strap 101 is shown for reference, as well as electrical wiring 118 which may be used to connect the battery and/or motor control and electronics contained within housing structure 108 to a controller to be held by the user. Paddleboard T-bolts 114 may be used to retain propulsion system 200 to the water facing surface of a paddleboard 102 as hereinbefore described. Electrical connector 119, which may be a watertight connector, is shown for reference. Housing structure 108 and optional strap 101 are shown for reference.

Figure 6:
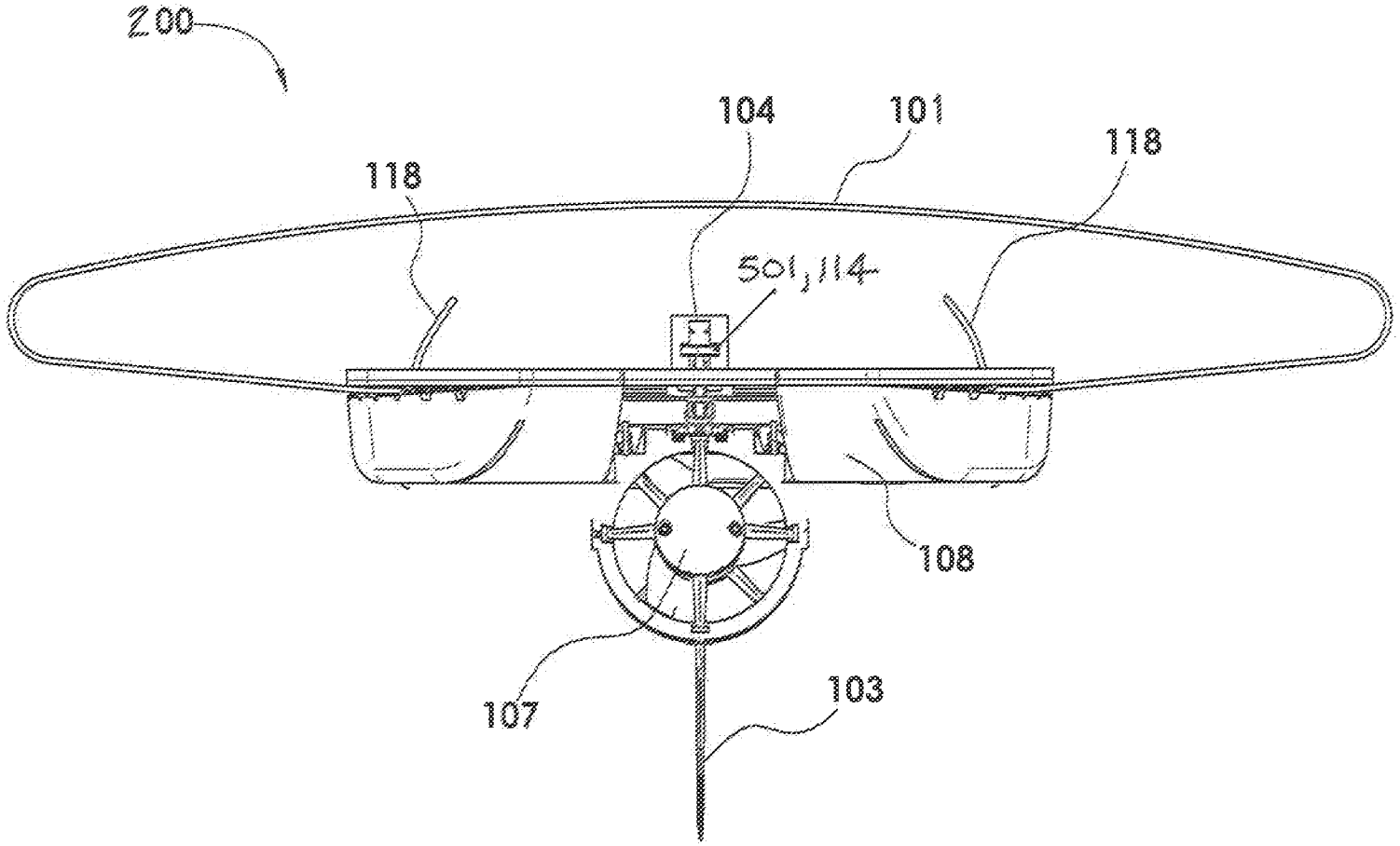
FIG. 6 depicts an orthogonal rearview of an embodiment of the invention.

Referring now to FIG. 6, a rear view of an embodiment of propulsion system 200 is depicted. In embodiments, controllable electric motor/propeller 107 may be disposed underneath the water-facing side of a paddleboard 102 such that it provides a direction of thrust along axis 500 of paddleboard 102. The centerline of controllable electric motor/propeller 107, and the orientation of the directional control of fin 103, may be directed along paddleboard axis 500. Fin box 104, which normally is an integral part of paddleboard 102, is depicted for reference. Receiving grooves 501 in fin box 104, which receive and retain the elongate heads of paddleboard T-bolts 114, are shown for reference. Electrically conductive wiring 118 may be utilized to attach the controller electronics, battery, and electric motor 107 to a handheld controller to be held by a user standing, kneeling, or sitting on an upward facing surface of paddleboard 102.

In operation, a propulsion system 200 of the invention may be removably attached to a water facing surface of the paddleboard 102. The propulsion system 200 may be attached to the water facing surface of the paddleboard 200 without requiring removal of fin 103 from fin box 104. In typical use, a user may place a paddleboard 102 on a horizontal surface, such as the ground or a table, with the normally-upper-facing surface of paddleboard 102 facing downward. In other words, during assembly of the paddleboard propulsion system 200 onto a paddleboard 102, the paddleboard 102 may be flipped upside down such that fin 103 is protruding in an upward direction. A user may then motivate propulsion system 200 against the water facing surface of paddleboard 102, orienting propulsion system 200 such that fin 103 protrudes through fin-receiving openings 504, 504, and 500 in propulsion system plate 105, plate 106 and paddleboard propulsion system housing structure 108, respectively. A user may then slide paddleboard T-bolts 114 along their receiving slots in fin box 104 such that they align with mating holes for receiving them disposed in paddleboard retained brackets 109 and 110. Female threaded fasteners may then be tightened onto the male threaded portion 502 of paddleboard T-bolts 114, thereby attaching the paddleboard propulsion system 200 to the water facing surface of paddleboard 102 and a removable attachment.

If desired, optional elastic or length-adjustable strap 101 may be utilized to snugly fit around paddleboard 102 and pass through housing structure 108, further retaining paddleboard system 200 to the water facing side of paddleboard 102. Thus paddleboard system 200 may be removably attached to the water facing side of paddleboard 102. A user may then connect electrical wiring 118 to a handheld or wrist-worn controller 1002 to be held or worn by the user as the user sits, stands or kneels on an upper surface of paddleboard 102. The controller 1002 may comprise a user interface having, for example, buttons, switches or other user interface elements such that the user is able to input commands to controller 1002 for controlling the speed, and, in embodiments, the direction, of the paddleboard 102 along the body of water by controlling the amount and direction thrust produced by controllable electric motor/propeller 107. Controllable electric motor/propeller 107 may be controlled by the user inputting commands into the controller 1002 for controlling the speed of rotation of controllable electric motor/propeller 107 or the direction of spin of controllable electric motor/propeller 107 thus allowing forward or reverse operation, or both. Further, in embodiments, a user may control the angular direction of thrust of controllable electric motor/propeller 107 in a plane that is parallel to a plane formed by surface of the body of water by controlling the rotation of controllable electric motor/propeller 107 along arrow A, thus enabling angular rotation of a thrust vector of controllable electric motor/propeller 107 for providing thrust having a transverse component. In such embodiments, the rotation of controllable electric motor/propeller 107 along arc A, and thus the controlling of the angular direction of the thrust vector produced by controllable electric motor/propeller 107 may be enabled by a controllable servo motor, controllable rotary actuator or other device for rotating the motor/propeller along arrow A that may be a part of the attachment of controllable electric motor/propeller 107 to housing 108 or other structure or the propulsion system of the invention. A user may input commands for controlling the angle of thrust vector produced by controllable electric motor/propeller 107 by inputting commands into the controller 1002 user interface, whereupon the commands may be communicated 1002 to the controllable servo motor or rotary actuator for controlling the thrust vector angle. Alternatively, a user may input commands for controlling the angle of thrust vector produced by controllable electric motor/propeller 107 by inputting commands into the controller user interface, whereupon the commands may be communicated to processor 1000, which then communicates the commands to the controllable servo motor or rotary actuator for controlling the thrust vector angle.

In any of the embodiments, a user may control the paddleboard to be propelled in a forward or reverse direction by controlling direction of rotation of controllable electric motor/propeller 107 by inputting commands into the controller 1002 user interface.

Figure 7:
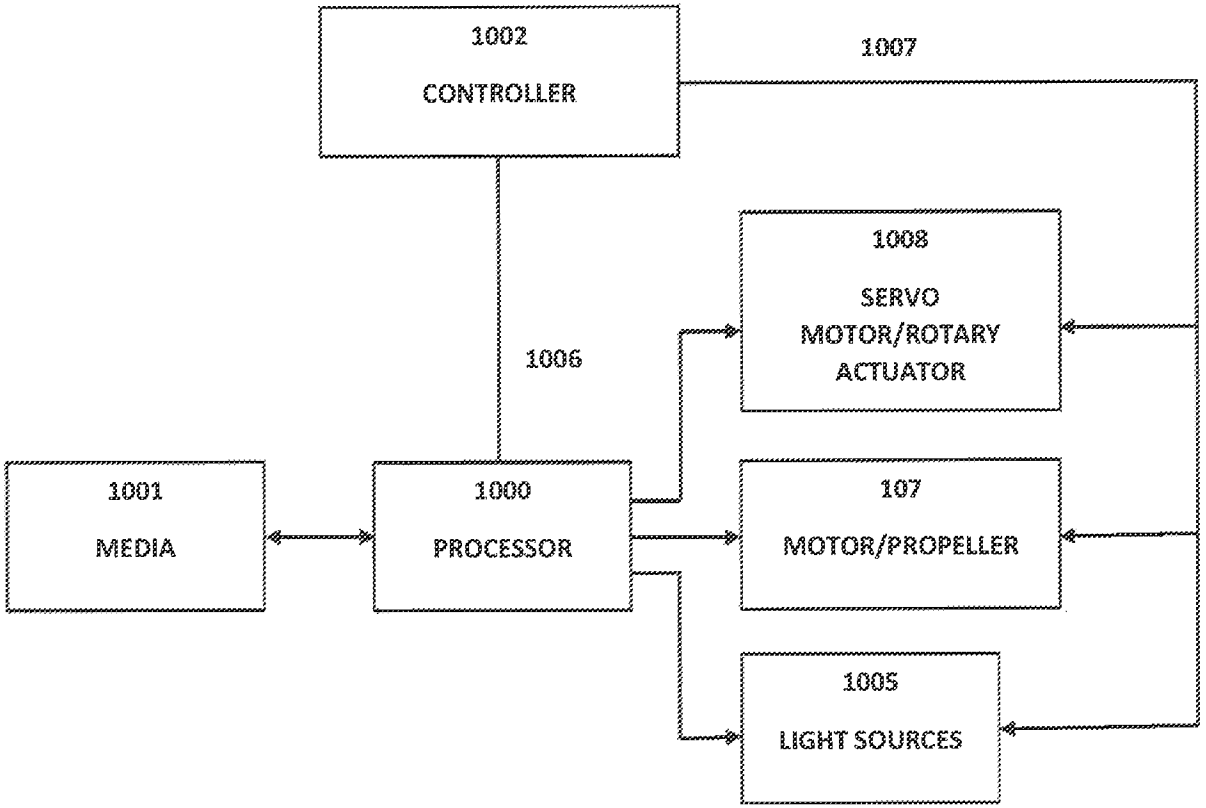
FIG. 7 depicts an exemplary block diagram of an embodiment of the invention.

Referring now to FIG. 7, in embodiments comprising a processor 1000, processor 1000 may be in wired or wireless communication 1006 with controller 1002, and commands input by the user into the controller 1002 may be communicated to processor 1000 by the controller. Processor 1000 may read and execute computer readable and computer executable instructions stored in physical storage media 1001, and then may communicate commands to controllable electric motor/propeller 107 and other system elements such as optional light sources 1005 or optional servo motor or rotary actuator 1008 as needed to carry out the functions of the invention described herein. Processor 1000 and physical storage media 1001 are optional, and need not be present in all embodiments.

Still referring to FIG. 7, in embodiments, controller 1002 may be in direct wired or wireless communication 1007 with controllable electric motor/propeller 107, and commands for controlling the speed of propeller rotation (thus controlling amount of thrust), and direction of propeller rotation, that are input into the user interface of controller 1002 are directly communicated to the controllable electric motor/propeller 107 such that the speed of propeller rotation, and direction of propeller rotation of the controllable electric motor/propeller 107 are controllable by a user as desired. Further, controller 1002 may be in direct wired or wireless communication 1007 with optional controllable lights 1005 and optional controllable servo motor or rotary actuator 1008 such that user commands for controlling angular direction of trust that are input into the user interface of controller 1002 may be directly communicated to optional controllable servo motor or rotary actuator 1008, and that user commands for controlling intensity of light sources 1005 that are input into the user interface of controller 1002 may be directly communicated to optional light sources 1005.

In embodiments, any battery forming a part of 111 or 116, or any battery comprising the system, may be removable or rechargeable, or both, and may be in electrical communication with each component of the invention that requires electrical power to operate.

In embodiments, the controller 1002 may be used by the user to control the speed of rotation, and, in embodiments, direction of rotation, of controllable electric motor/propeller 107, thus controlling the amount of thrust, and, in embodiments, the direction of thrust, applied to paddleboard 102. In embodiments, the controller may take the form of a wireless or wired wearable controller that is worn for example on the wrist of the user. In this embodiment, the wearable controller may comprise a wireless receiver/transmitter in communication with processor 1000 and a user interface, all comprising the wearable controller. The wearable controller user interface may be for example a touchscreen comprising soft switches, or it may be physical buttons or switches, or it may be a microphone in communication with a processor for recognizing audio commands for controlling the controllable elements of the invention as described herein. The receiver/transmitter of the wearable controller may be in wireless data communication with a compatible receiver/transmitter in communication with, or forming a part of, processor 1000. In this configuration, control of the amount thrust and, in embodiments, the direction of thrust of produced by controllable electric motor/propeller 107 may be accomplished wirelessly by a user inputting commands into the user interface of the wearable controller.

In embodiments, the propulsion system may comprise one or more controllable light sources 1005, such as, for example, Light Emitting Diodes (LEDs) disposed in the housing structure. The intensity of light, or color of light, or both, emitted by the light sources 1005 may be controllable by a user by inputting commands into the user interface of controller 1002 that are communicated directly to the controllable light sources wirelessly or in a wired fashion. In embodiments, the commands may be communicated by the controller to a processor 1000, which in turn communicates the commands for controlling the intensity of light, or color of light, or both, emitted by the light sources 1005 to the light sources. In such cases the light sources may be in communication with processor 1000. In embodiments, the light sources 1005 may be oriented so as to direct their radiated light energy away from the water-facing side of paddleboard 102 such that the water underneath paddleboard 102 is illuminated when the paddleboard is in normal use on a body of water. In embodiments the light sources 1005 may only be controllable user as to ON or OFF state. In embodiments, the intensity of the light radiated light sources 1005 may be controllable by the user.

In embodiments, any of the claimed features may be present, or may not be present, in any quantity and in any combination.

Although a detailed description as provided in the written description and drawings contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

Thus the scope of the invention should be determined by the appended claims and their legal and structural equivalents, and not merely by the preferred examples or embodiments given.

What is claimed is:

1. A controllable apparatus for propelling a paddleboard along a surface of a body of water, comprising:

a structure adapted to be attached to a water-facing surface of a paddleboard, said structure comprising a housing having an opening therethrough allowing a fin mounted in a fin box of the paddleboard to protrude through the structure;

a controllable electric motor attached to said structure, said controllable electric motor having a rotable shaft with a propeller attached thereto, said controllable electric motor operable to rotate the propeller such that thrust is developed when the paddleboard is floating on the body of water, said thrust tending to motivate said paddleboard in a direction of travel along the surface of the body of water; and a controller in communication with said controllable electric motor, said controller having a user interface for receiving input commands from a user for controlling a controllable electric motor shaft rotation speed; and a battery in electrical communication with said controllable electric motor for providing electric power to said controllable electric motor;

wherein the amount of thrust produced when said propeller is rotated is controllable by a user inputting commands for controlling the controllable electric motor shaft rotation speed into the user interface; and wherein the structure is adapted to be attached to a water-facing surface of said paddleboard without requiring said fin to be removed.

2. The apparatus of claim 1, wherein a direction of rotation of said controllable electric motor shaft is controllable by a user inputting commands into said user interface such that a direction of thrust generated by said propeller is reversible upon command by the user.

3. The apparatus of claim 1 further comprising a strap passing through said structure and extending around the paddleboard so as to retain the structure to said water-facing surface of the paddleboard.

4. The apparatus of claim 1, wherein said structure is attached to said water-facing surface of the paddleboard by one or more T-bolts, wherein said one or more T-bolt heads are captured in a receiving grooves in said fin box.

5. The apparatus of claim 1, wherein said battery is contained within said housing.

6. The apparatus of claim 1, wherein said controller is defined as a handheld controller, and wherein said controller is in wired electrical communication with said controllable electric motor.

7. The apparatus of claim 1, in which said controller is wearable on the wrist of the user, and wherein said controller is in wired electrical communication with said controllable electric motor.

8. The apparatus of claim 1, further comprising a processor in communication with said motor, and wherein said controller is defined as a mobile device in wireless communication with said processor, wherein said commands input into said controller by a user are communicated by controller to said processor, and where said processor communicates said commands to said motor such that the motor is responsive to user commands for controlling the motor shaft rotation speed.

9. The apparatus of claim 1, further comprising one or more light sources disposed in said housing, said one or more light sources disposed so as to illuminate the body of water underneath the apparatus.

10. The apparatus of claim 9, wherein each of said one or more light sources is controllable as to intensity, and wherein said one or more light sources is in communication with said controller, and where said controller is adapted to receive commands input into said controller's input interface for controlling the intensity of said one or more light sources.

11. The apparatus of claim 1, further comprising a controllable servo motor or rotary actuator interposed between the controllable electric motor and the housing, such that the direction of thrust of the controllable electric motor is able to be controllably rotated in a plane that is parallel to a plane formed by surface of the body of water, and wherein said controllable servo motor or rotary actuator is in communication with said controller such that the user is able to control the direction of the angle of thrust vector produced by the propeller by inputting commands into the user interface of the controller.

12. A controllable apparatus for propelling a paddleboard along a surface of a body of water, comprising:

a structure adapted to be attached to a water-facing surface of a paddleboard, said structure comprising a housing having an opening therethrough allowing a fin mounted in a fin box of the paddleboard to protrude through the structure;

a controllable electric motor attached to said structure, said controllable electric motor having a rotable shaft with a propeller attached thereto, said controllable electric motor operable to rotate the propeller such that thrust is developed when the paddleboard is floating on the surface of the body of water, said thrust tending to motivate said paddleboard in a direction of travel along the surface of the body of water;

a controller in communication with said controllable electric motor, said controller having a user interface for receiving input commands from a user for controlling the controllable electric motor shaft rotation speed; and a battery in electrical communication with said motor for providing electric power to said controllable electric motor;

wherein the amount of thrust produced when said propeller is rotated is controllable by a user inputting commands for controlling the controllable electric motor shaft rotation speed into the controller user interface;

wherein a direction of rotation of said controllable electric motor shaft is controllable by the user inputting commands into said controller user interface such that a direction of thrust generated by said propeller is reversible upon command by a user;

wherein the structure is adapted to be attached to a water-facing surface of said paddleboard without requiring said fin to be removed.

13. The apparatus of claim 12, further comprising a strap passing through said structure and extending around the paddleboard so as to retain the structure to the water-facing surface of the paddleboard.

14. The apparatus of claim 12, wherein said structure is attached to said water-facing surface of the paddleboard by one or more T-bolts, wherein said one or more T-bolt heads are captured in receiving grooves in said fin box.

15. The apparatus of claim 12, wherein said battery is contained within said housing.

16. The apparatus of claim 12, wherein said controller is defined as a handheld controller, and wherein said controller is in wired electrical communication with said controllable electric motor.

17. The apparatus of claim 12, in which said controller is wearable on the wrist of the user, and wherein said controller is in wired electrical communication with said controllable electric motor.

18. The apparatus of claim 12, further comprising one or more light sources disposed in said housing, said one or more light sources disposed so as to illuminate the body of water underneath the apparatus.

19. The apparatus of claim 12, further comprising a controllable servo motor or rotary actuator interposed between the controllable electric motor and the housing, such that the direction of thrust of the controllable electric motor is able to be controllably rotated in a plane that is parallel to a plane formed by surface of the body of water, and wherein said controllable servo motor or rotary actuator is in communication with said controller such that the user is able to control the direction of the angle of thrust vector produced by the propeller by inputting commands into the user interface of the controller.

* * * * *